United States Patent [19]

Kumada et al.

[11] 4,352,961

[45] Oct. 5, 1982

[54] TRANSPARENT FLAT PANEL PIEZOELECTRIC SPEAKER

[75] Inventors: Akio Kumada, Kokubunji; Shigeo Nakamura, Hino, both of Japan

[73] Assignee: Hitachi, Ltd., Tokyo, Japan

[21] Appl. No.: 155,228

[22] Filed: Jun. 2, 1980

[30] Foreign Application Priority Data

Jun. 15, 1979 [JP] Japan ..... 54-74698
Apr. 25, 1980 [JP] Japan ..... 55-54226

[51] Int. Cl.[3] ..... H04R 1/02; H04R 17/00

[52] U.S. Cl. ..... 179/110 A; 310/321; 310/324; 368/255; 455/350; 455/351

[58] Field of Search ..... 179/110 A; 310/321, 310/324; 368/255

[56] References Cited

U.S. PATENT DOCUMENTS 4,048,454 9/1977 Barcus et al. ..... 179/110 A

*Primary Examiner*—George G. Stellar

*Attorney, Agent, or Firm*—Kenyon & Kenyon

[57] ABSTRACT

This invention intends to provide a speaker which assumes a comparatively large area in a device without spoiling various display effects. The transparent flat panel speaker of this invention is a speaker of high efficiency which can give forth a sound volume large considering the small-sized device even when driven by a low voltage.

The transparent flat panel speaker of this invention comprises, at least, a transparent resonator plate and a plate of a piezoelectric material held between at least one pair of electrodes, the resonator being excited by the piezoelectric material plate, a periphery of the resonator plate having a shape which is represented by a curve or in which straight lines are connected by smooth curves with at least two centers of curvature.

As the peripheral shapes, an ellipse, a curve expressed by $X^n/a+Y^n/b=1$, a plane figure obtained by molding the corners of a polygon circumscribed or inscribed to an ellipse, etc. are especially favorable for the speaker.

13 Claims, 26 Drawing Figures

FIG. 4ℓ

TRANSPARENT FLAT PANEL PIEZOELECTRIC SPEAKER

BACKGROUND OF THE INVENTION

1. Field of the Invention

This invention relates to a flat panel speaker which employs a plate of a transparent piezoelectric material.

2. Description of the Prior Art

Recently, the speech synthesizer has proceeded in micro electronic devices such as melody speaking wrist watches and electronic micro-calculator. In the electronic wrist watch, multifunctional factors have been required because the expression of a time is not limited to a visual one but a specified time needs to be aurally expressed as an alarm sound or the like.

By way of example, the conventional construction of a digital electronic timepiece of this type consists of an optical dial which is provided with a character display or second-hand (moving needles) display, a metallic body which supports the watch module, a piezoelectric element which is installed in the body, and a front glass plate which is stuck to be unitary with the piezoelectric element. The glass plate with a piezoelectric element is resonated in a predetermined frequency band by applying an electric alarm signal, and the vibration generates a buzzer sound, melody or the like. In the buzzer for the watch, the sound of any specified frequency within a frequency range of 2–4 KHz is selected, and the resonator is excited at its single resonance frequency in order to produce the sound at the lowest possible voltage. Thus, as the resonance frequency of the resonator is as simpler as can be, (that is, Q becomes higher), the efficiency becomes higher, so that the disk shape resonator has been used in practice and free from subresonances etc.

Such buzzers for watches are disclosed in Japanese Patent Application Laid-open Specification No. 55171/1978, etc.

Further, there has recently been proposed a watch which is endowed with the function of generating, not only the buzzer sound, but also a melody sound. These digital watches which appeal to the ear are also used for the drivers of running cars and bicycles and for the visually handicapped.

The buzzer sound, however, has been disadvantageous in that since originally it is intensely felt as an alarm or an emergency sound, it promotes a psychological restlessness more than is necessary, so it is not accepted as a pleasant sound. In order to change the sound quality so as to bring the buzzer sound close to the human voice, bulky accessory circuits including a speech synthesizer are required. This measure is considered impossible for small-sized electronic appliances such as the digital watch.

As another example of the prior art, there has been an idea according to which a voice producing source such as subminiature speaker is intended to be contained inside the body of a watch. Since, however, the watch originally requires hermetic sealing for water-proof etc., the idea is undesirable in point of disposing a perforated portion for emitting sounds. Furthermore, the small-sized electronic appliances such as watches require decorative factors. Especially the installation of an accessory component for another function onto the dial side spoils the sense of beauty and is demeritorious commercially. This has led to the disadvantage that a space for installing sound producing means is limited still more.

Further, many of electronic computers and devices for education etc. have recently been provided with a speech synthesizer, that is, micro talking devices, which produces human voices. These appliances are generally driven with batteries, and are desired to be small in size and light in weight. In this regard, a speaker portion occupies a large space and is therefore desired to be miniaturized. A miniature speaker, however, has had the disadvantage of an inferior sound quality.

SUMMARY OF THE INVENTION

This invention intends to provide a speaker which can secure a comparatively large area in a device without spoiling various display effects. The transparent flat panel speaker of this invention is a speaker of high efficiency which can give forth a sound volume large considering the small-sized device even when driven by a low voltage.

The transparent flat panel speaker of this invention comprises, at least, a transparent resonator plate and a plate of a piezoelectric material held between at least one pair of electrodes, the resonator plate being excited by the piezoelectric material plate, a periphery of the resonator plate having a shape which is represented by a curve or in which straight lines are connected by smooth curves with at least two centers of curvature.

As the peripheral shapes, an ellipse, a curve expressed by $X^n/a+Y^n/b=1$, a plane figure obtained by molding the corners of a polygon circumscribed or inscribed to an ellipse, etc. are especially favorable for the speaker.

Applicable as the resonator plate is a transparent inorganic material such as glass, quartz and sapphire, or a transparent synthetic resin having a predetermined harness such as acrylic resin. This invention is especially effective when applied to that length of the resonator plate which ranges 1 cm–10 cm or so.

Usable as the piezoelectric material is the crystal of PZT ($Pb(Zr, Ti)O_3$)-based transparent ceramics such as lanthanum-doped zirconium titanate (PLZT), $(PbBa)(Zr, Ti)O_3$, $(PbSr)(ZrTi)O_3$ and $(PbCa)(ZrTi)O_3$, barium titanate, or an organic material such as polyvinylidene fluoride.

As the transparent electrodes, thin films of the well-known $In_2O_3$-$SnO_2$ system, etc. can be satisfactorily used.

BRIEF DESCRIPTION OF THE DRAWINGS

FIGS. 2*a*–2*h* and FIGS. 4*a*–4*l* are graphs showing the frequency characteristics of transparent flat panel speakers.

DETAILED DESCRIPTION OF THE PREFERRED EMBODIMENTS

Hereunder, this invention will be described in detail with reference to embodiments.

Figure 1:
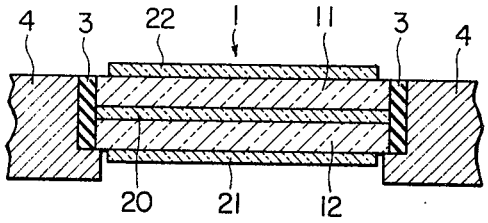
FIG. 1 is a partial sectional view of a piezoelectric bimorph driver plate used in this invention.

FIG. 1 is a schematic sectional view of the essential portions of a transparent flat panel speaker embodying this invention.

A piezoelectric bimorph driver plate 1 is fitted in a casing 4 with a packing 3 interposed therebetween. The driver 1 is so constructed that transparent plates 11 and 12 made of a ceramic piezoelectric material such as lanthanum-doped zirconium titanate (in general, shortly termed "PLZT") are inserted between the adjacent ones of transparent electrodes 20, 21 and 22 made of tin oxide ($SnO_2$), indium oxide or the like. When predetermined electric signals are applied to the electrodes, an elliptic flat glass resonator plate (not shown) is vibrated to transmit speech to the surroundings.

A range of 0.1 mm–1.5 mm in terms of the thickness of a resonator is favorable. And a range of 0.1 mm–0.5 mm in terms of the thickness of a transparent piezoelectric material and a range of 1 cm–10 cm in terms of length can be applied to the speaker.

Now, suppose by way of example a case where "three o'clock" is indicated by voices produced with the speaker in an electronic timepiece. Speech synthesizers which produce the voices of time contents and time units respectively are stored as quantized voice digital information by a read only memory (in general, abbreviated to "ROM") in advance. When the hands have indicated three o'clock, the speech synthesizers are successively read out and transmitted to the driver 1 as electric signals. Then, the speaker announces "It is three o'clock now".

In order to bring the voice production of the speaker close to the natural human voice, the inventor conducted experiments by varying the shape of the resonator. As a result, it has been revealed that shapes to be described below are very favorable for this purpose.

Table 1 indicates the results of the experiment on the frequency characteristics of the speaker as conducted by varying the shape of the transparent flat glass plate. In this case, the lengths of the major axis and the minor axis of the ellipse were varied. Although no unit is indicated because the dimensions were normalized, the minor axis was made 2 cm by way of example. The glass was conventional hard glass, and was 1.0 mm thick.

The speaker is usable preferably in case where the major axis is $\sqrt{1.5}$–$\sqrt{2.5}$ times longer than the minior axis, and more preferably in case where the former is $\sqrt{1.75}$–$\sqrt{2.25}$ times longer than the latter. The appearances of the frequency distributions of sound outputs in these cases are shown in FIGS. *2a–2h*. The respective figures correspond to Sample Nos. 1–8 in Table 1. When the major axis is 1 times the minor axis, that is, the shape of the glass plate is a "circle", the quality factor Q of the disk resonator is very sharp and high. When the major axis is $\sqrt{1.5}$–$\sqrt{2.5}$ times longer than the minor axis, the resonator has so many vibrations modes that it shows subsequent resonances in a rather narrow frequency range. Thus, a peak value at a specific frequency is not exhibited, but a frequency distribution having wide-band regions is exhibited. The wide-band regions arose within a band width of 1.0 KHz–4.0 KHz, and speech synthesizers of about 200 words could be clearly heard in a place 1 m distant from the speaker. This suffices for listening to ordinary conversation. Moreover, a sound volume large enough to be heard with a battery of approximately 1.5 V could be attained.

TABLE 1

| No. | Major axis | Minor axis | Frequency characteristics |
|---|---|---|---|
| 1 | $\sqrt{1.0}$ | 1.0 | bad |
| 2 | $\sqrt{1.25}$ | 1.0 | bad |
| 3 | $\sqrt{1.5}$ | 1.0 | good |
| 4 | $\sqrt{1.75}$ | 1.0 | better |
| 5 | $\sqrt{2.0}$ | 1.0 | excellent |
| 6 | $\sqrt{2.25}$ | 1.0 | better |
| 7 | $\sqrt{2.5}$ | 1.0 | good |
| 8 | $\sqrt{2.75}$ | 1.0 | bad |

Table 2 lists the results of the experiment on the frequency characteristics of the speaker as conducted by varying the shape of the resonator. In this case, the propriety of the shape for the frequency characteristics was experimentally studied by varying the shape of the resonator by changing a value n in the following expression (1) as is well known:

$$x^n+y^n=1 \quad (1)$$

n: positive number

Figure 3:
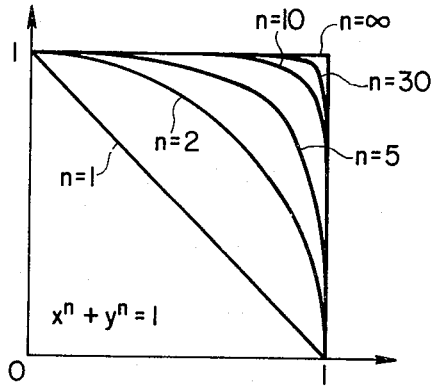
FIGS. 3 and 5 are diagrams for explaining the shapes of resonators.

FIG. 3 serves to more clarify the explanation of Table 2, and graphically illustrates a part of the above expression (the first quadrant). As apparent from the figure, $n=1$ represents a square, $n=2$ a circle, and $n=\infty$ (infinity) a square. As the value n becomes greater, the shape of the circle collapses gradually to come closer to the square.

TABLE 2

| No. | n | Frequency characteristics | Remarks |
|---|---|---|---|
| 1 | 1 | bad | rhomb |
| 2 | 2 | bad | circle |
| 3 | 3 | possible | |
| 4 | 4 | better | |
| 5 | 5 | excellent | |
| 6 | 10 | excellent | |
| 7 | 20 | better | |
| 8 | 30 | possible | |
| 9 | 50 | bad | |
| 10 | ∞ | bad | square |

As apparent from Table 2, this experiment has revealed that values of from $n=3$ to $n=20$ afford characteristics usable in the speaker, preferably a range of $n=5$–10 providing characteristics as a favorable speaker. The reason why the case of the circle is unsuitable is considered the same as in the foregoing experiment, and is not repeated here. In the case of the square, since the four corners will act as singular points at the resonance, a large number of harmful resonance modes will develop to sharply lower the output as the sound volume, so the effect as the speaker will degrade. Accordingly, it is readily understood that the optimum shape exists between the circle and the square.

Further, the shape of the resonator was studied as a shape which is represented by the following expression when normalized:

$$X^n/a+Y^n/b=1$$

(n: positive number)

As a result, it has been revealed that shapes as specified below are favorable for the speaker.

(1) When n=1, characteristics are unsuitable for the speaker irrespective of the axial ratio b/a.

(2) When n=2, a range of $\sqrt{1.5}$–$\sqrt{2.5}$ in terms of the axial ratio is favorable as indicated in Table 1. (This is the example of the ellipse stated before.)

(3) When n=3, a range of $\sqrt{1.25}$–$\sqrt{2.5}$ in terms of the axial ratio b/a is favorable.

(4) When $20 \geqq n \geqq 4$, a range of 1–$\sqrt{2.5}$ in terms of the axial ratio is favorable.

Regarding n=2 to 4, the preferable lower limit of the axial ratio is roughly a magnitude obtained by interpolating each value.

(5) When $n \geqq 20$, characteristics are unfavorable irrespective of the axial ratio.

Among all, a range in which $n=4$ to 20 and $b/a=\sqrt{1.75}$ to $\sqrt{2.25}$ is favorable.

Table 3 lists the results of frequency characteristics studied by varying the shape of the resonator. FIGS. 4*a*–4*l* show the frequency characteristics of sound outputs. The respective figures correspond to the following shapes:

(1) n=1, a=b (comparative example)
(2) n=2, a=b (comparative example)
(3) n=4, b=$\sqrt{1.75}$ a
(4) n=4, b=$\sqrt{2}$ a
(5) n=4, b=$\sqrt{2.25}$ a
(6) n=5, b=$\sqrt{2}$ a
(7) n=10, b=$\sqrt{2}$ a
(8) n=20, b=$\sqrt{1.75}$ a
(9) n=20, b=$\sqrt{2}$ a
(10) n=20, b=$\sqrt{2.25}$ a
(11) n=30, b=$\sqrt{2}$ a
(12) n=30, a=b (comparative example)

Sample Nos. 1, 2 and 12 are examples which are unfavorable for the speaker.

TABLE 3

| No. | n | a | b | Frequency characteristics |
|---|---|---|---|---|
| 1 | 4 | 1 | $\sqrt{1.75}$ | possible |
| 2 | 4 | 1 | $\sqrt{2.0}$ | good |
| 3 | 4 | 1 | $\sqrt{2.25}$ | possible |
| 4 | 5 | 1 | $\sqrt{1.75}$ | better |
| 5 | 5 | 1 | $\sqrt{2.0}$ | excellent |
| 6 | 5 | 1 | $\sqrt{2.25}$ | better |
| 7 | 10 | 1 | $\sqrt{1.75}$ | better |
| 8 | 10 | 1 | $\sqrt{2.0}$ | excellent |
| 9 | 10 | 1 | $\sqrt{2.25}$ | better |

TABLE 3-continued

| No. | n | a | b | Frequency characteristics |
|---|---|---|---|---|
| 10 | 20 | 1 | $\sqrt{1.75}$ | possible |
| 11 | 20 | 1 | $\sqrt{2.0}$ | good |
| 12 | 20 | 1 | $\sqrt{2.25}$ | possible |

Figure 5:
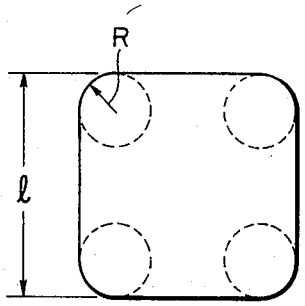

Table 4 indicates the results of the experiment on the frequency characteristics of the speaker as conducted by varying the shape of the resonator. In this case, the corners of a glass plate one side of which was 3 cm were rounded by smooth molding or chamfering, and the radius of the molding was represented by percentage (%) relative to the length of one side of the plate. FIG. 5 illustrates how to take the proportion of the radius of the molding relative to the length of one side. In the illustrated case, the polygon is a square, and the length of one side and the radius of the molding of the corner are respectively denoted by l and R. The same concept applies to any other polygon. The material and thickness of the glass plate were the same as in the foregoing experiment.

TABLE 4

| No. | Porportion of R | Frequency characteristics |
|---|---|---|
| 1 | 1% | bad |
| 2 | 2 | bad |
| 3 | 3 | good |
| 4 | 4 | good |
| 5 | 5 | better |
| 6 | 7 | better |
| 7 | 10 | excellent |
| 8 | 20 | better |
| 9 | 30 | good |
| 10 | 50 | bad |

As apparent from the table, frequency characteristics at 3–30% in terms of the proportion of the radius R of the molding, that is, at 0.9 mm–9 mm in this case can be applied to the speaker, and those at 5–20% are more favorable. These preferable dimensions will also be based on a frequency distribution having wide-band regions and a feasible sound volume. Although one side was 3 cm long in this experiment, it is needless to say that the size is not restricted thereto but that it is effective to lengths of 1–10 cm or so feasible as small-sized electronic devices. When the size is changed, the central position of the frequency distribution having wide-band regions deviates, and it is needless to say that a favorite sound range can be selected by making the resonator small for a low-pitched sound and large for a high-pitched sound. Further, in cases where samples of the resonator were rectangular and where they had the shapes of polygons such as a pentagon, a hexagon and an octagon, similar characteristics were exhibited owing to the molding of the corners of the polygons. In these cases, the frequency distributions had wide-band regions but exhibited somewhat complicated shapes. It has been revealed, however, that such frequency distributions ensure satisfactory operations without any inconvenience as the speaker.

The polygons should preferably be comparatively elongate. Regarding the ratio between the length of the narrower side and that of the broader side, values on the order of $1:\sqrt{1.5-1}:\sqrt{2.5}$ are preferable as in the case of the ellipse.

Shapes obtained by molding or rounding the corners of polygons which are circumscribed or inscribed to the ellipse previously stated are also recommended for the speaker. As the ellipse, ones in which the major axis is $\sqrt{1.5}$–$\sqrt{2.5}$ times (preferably, $\sqrt{1.75}$–$\sqrt{2.25}$ times) longer than the minor axis are suitable as described before, while the proportion of the molding suitably ranges 5–20% in terms of the percentage of the radius of the molding relative to one side.

Examples of such shapes will now be mentioned. A transparent piezoelectric ceramic plate of lanthanum-doped zirconium titanate (PLZT) which was 0.2 mm thick and which was in the shape of an ellipse having a major axis of 30 mm and a minor axis of 22 mm was prepared. The transparent piezoelectric ceramic plate was formed with transparent electrodes on both its major surfaces, and was subjected to poling process. A reinforced glass plate which was 0.6 mm thick and which was in the shape of an octagon circumscribed to the ellipse was prepared, and it had its peripheral corners molded in conformity with a circle having a radius equal to 10% of each side. The spacing of the parallel longer sides was 23 mm, and that of the parallel shorter sides was 33 mm. The resultant plate of reinforced glass was used as a resonator, and was bonded to the transparent piezoelectric plate with a transparent binder. The transparent flat panel speaker thus formed exhibited a frequency response which was acoustically favorable.

Even when the external shape of the aforecited resonator had the mutually opposing straight line parts thereof changed into curves indicated by $X^7/33+Y^7/23=1$, frequency responses were sufficiently obtained at a range of 1–4 KHz.

In this manner, also the figures in which the various shapes previously described are smoothly combined are favorable for the speaker.

The several experiments referred to above can be summed up as follows from the standpoint of the flat panel speaker.

The development of the frequency characteristics of the miniature flat panel speaker, especially the characteristics of multi mode resonances distributed sequentially at the wide band, is greatly affected by the shape of the resonator. In case where the shape is a circle, the resonance frequency demonstrates a single peak at a specified frequency, so that the circular resonator is unsuited to use as the speaker. In case where the shape is a tetragon such as square and oblong or where it is a polygon having more sides, the voice output lowers conspicuously and the sound volume as the speaker is insufficient. Therefore, a shape departing from the circle is prepared, or alternatively, the corners of the tetragon or polygon are rounded, that is, they are subjected to the smooth molding, whereby the frequency distribution profile having the wide band within a frequency range of at least 1 KHz–4 KHz can be developed, and a speaker having frequency characteristics appropriate as a talking device can be provided.

In this regard, in order to produce a clear voice by the use of the speaker, it is desirable that the speaker exhibits flat frequency characteristics over the whole audible band of 30 Hz–30 KHz. However, insofar as only voices are concerned, the band can be compressed in the extreme. By way of example, even in case where the response is limited to a range of 1 KHz–3 KHz, fairly clear voices can be produced. In practical use, a voice frequency band width of at least 500 Hz suffices.

Since the speaker of this invention utilizes the resonance characteristics, it cannot assume an essentially wide band. However, as a characterizing feature thereof, it can cover a band enough to reproduce voices and can provide means sufficiently effective for the purpose of producing clear voices.

The transparent flat panel speaker of this invention is insufficient for reproducing a symphony, but it is sufficient for expressing a daily conversation and a melody and it can express simple terms etc. for a time, alarm, notice etc. in the form of words as the so-called talking device.

In this manner, the invention affords the function of the speaker for the talking device unlike that of conventional hi-fi speakers for reproducing faithful sounds and can thus attain a large sound volume considering the small size and the low power. In addition, since both the resonator and the exciting plate are made of the transparent materials, the effect of beauty is high, which brings forth the advantage that the speaker is extensively applicable to small-sized electronic devices such as timepieces the significance of which as accessories is important.

Figure 6:
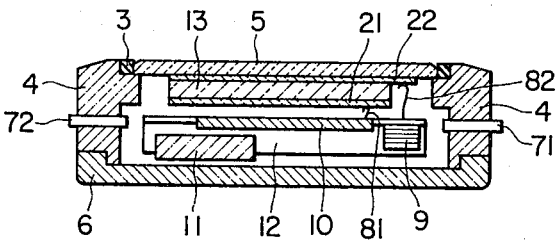
FIG. 6 is a schematic sectional view of a transparent flat speaker for use in a digital watch.

FIG. 6 is a schematic sectional view of the application of a transparent speaker to a melody timepiece. The melody timepiece is constructed by employing as a sound producer a bimorph driver in which transparent piezoelectric ceramics 13 provided with transparent electrodes 21 and 22 is stuck to a glass cover 5 of a wrist watch with a transparent binder.

Figure 7:
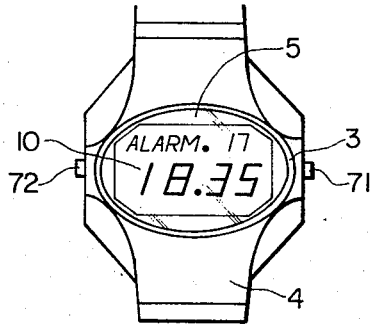
FIG. 7 is a plan view showing the actual packaging of the digital watch in FIG. 6.

Hereunder, concrete examples of application will be described. FIG. 7 is a plan view for explaining the melody timepiece referred to above. Numeral 10 designates a display panel of the watch, and numerals 71 and 72 designate a switch for changing-over time displays and a switch for adjusting a display time to a desired alarm time, respectively. Upon depressing the time display change-over switch 71, the display panel 10 changes to a mode which displays the set time of an alarm. The switch 72 is depressed to adjust the display time to the time desired to alarm the user. Thereafter, the switch 71 is depressed again to change-over the display panel to the ordinary time display. When the time to which the alarm has been set is reached, a melody signal is provided as the alarm from a circuit contained in a module and is boosted to 6 $V_{p\text{-}p}$ by means of a transformer 9. Then, an electric signal for the melody is applied across the transparent electrodes on both the surfaces of the piezoelectric ceramics through contact pieces $\mathbf{8}_1$ and $\mathbf{8}_2$. Such electronic circuit can be satisfactorily fabricated with the conventional technology of micromodules in the field of semiconductors. At this time, melody sounds are emitted from the cover glass 5 of the melody wrist watch. With the transparent flat panel speaker of this invention, the entire cover glass functions as the speaker. Therefore, the emission area of the sounds is large, and a melody abundant in the sound volume can be performed even when a battery 11 of 1.3 volt for timepieces is used as a power supply. Since the module for the watch is closed up by metal casings 4 and 6, the air within the casings is kept confined, and sounds inside the casings scarcely come out therefrom even when the sound pressure has risen due to the vibration of the speaker. Since, however, the cover glass itself vibrates as the sound producer as stated above, a sufficiently large sound volume is emitted to the exterior independently of the sealing of the air within the casing. Another merit is that, since the emission surface of sounds is always exposed, sounds are not intercepted as in case of assembling a speaker inside a watch.

When the transparent speaker is employed in this manner, it is the most important advantage that a resonator of large area can be constructed without hampering the display effect of a liquid crystal or semiconductor light emitting element or the like assembled in a device simultaneously with the resonator. In particular, the employment of the transparent speaker in a small-sized appliance is advantageous.

Figure 2A:
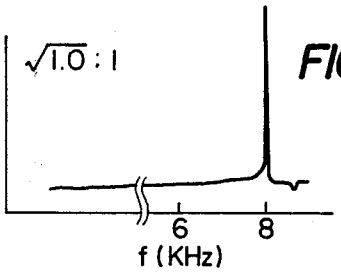
Figure 2B:
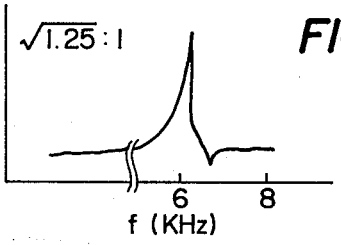
Figure 2C:
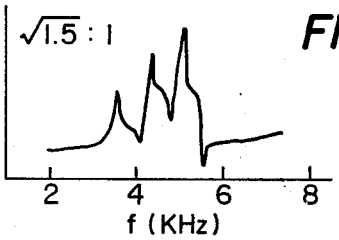
Figure 2D:
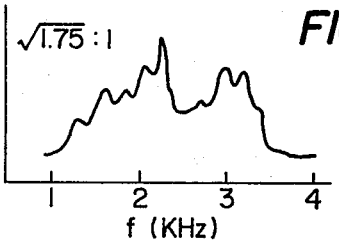
Figure 2E:
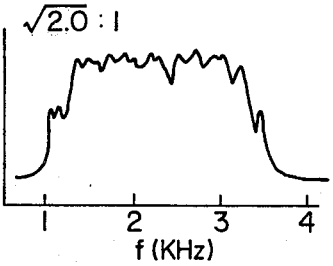
Figure 2F:
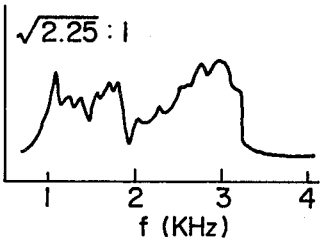
Figure 2G:
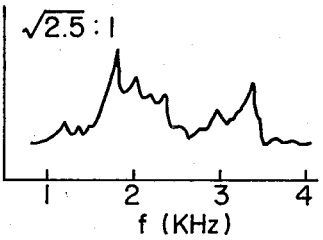
Figure 2H:
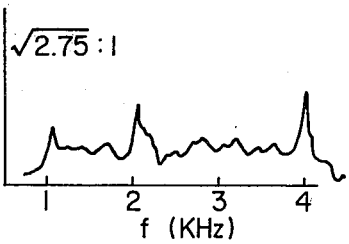
Figure 4A:
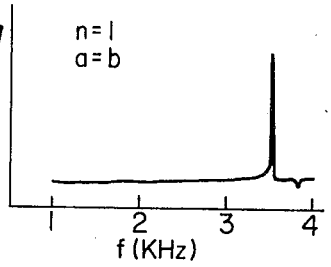
Figure 4B:
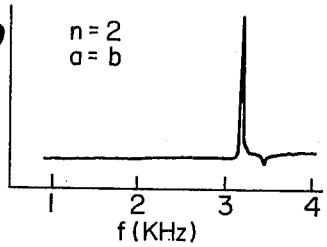
Figure 4C:
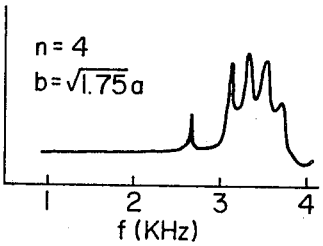
Figure 4D:
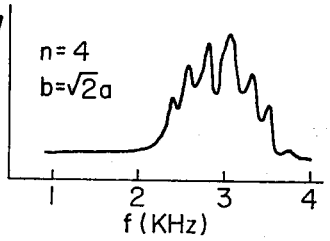
Figure 4E:
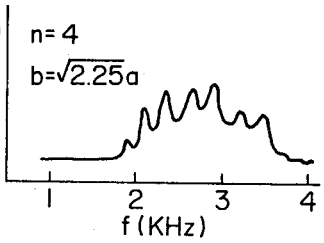
Figure 4F:
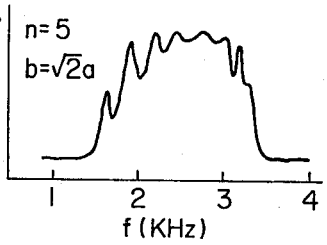
Figure 4G:
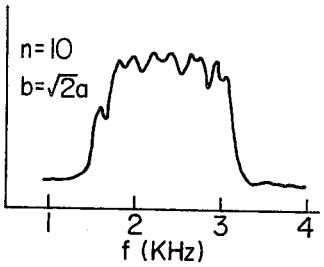
Figure 4H:
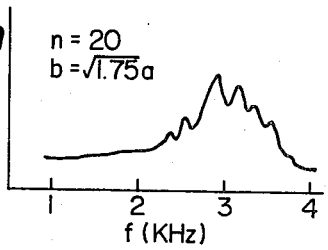
Figure 4I:
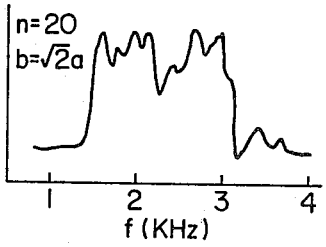
Figure 4J:
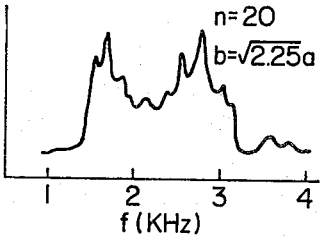
Figure 4K:
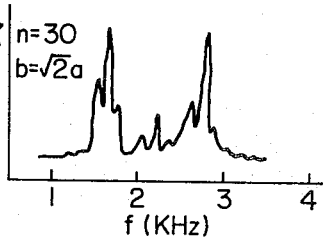
Figure 4K:
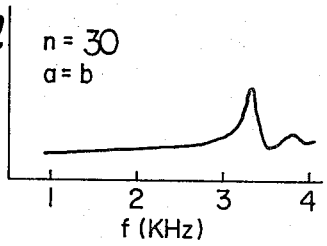

In an example of the transparent speaker of the melody watch in this invention, the shape of the surface of the cover glass 5 was an ellipse in which the major axis and the minor axis had a ratio of $\sqrt{2}$:1. After sticking the transparent piezoelectric driver onto the inner side, the cover glass was fitted in the casing 4 by the use of a packing 3, whereby the transparent speaker was constructed. An output from a sinusoidal sound generator as had its amplitude fixed was applied to the speaker while varying the frequency of the output in a range of 1 KHz–30 KHz. The frequency characteristics of sounds produced by the transparent speaker were quite the same as in the case of FIG. 2*e*, and had a frequency distribution with a wide frequency band between 1.5 KHz and 4.0 KHz.

In this manner, the elliptic resonator having the axial ratio of $\sqrt{2}$:1 becomes a wide-band resonator in which the frequency characteristics from the lowest resonance to the highest resonance are continuously coupled, because the resonance frequency of the bimorph resonator is proportional to the square of the length of the resonator.

When the elliptic transparent speaker in which the ratio of the lengths of the major axis and the minor axis is $\sqrt{2}$:1 is used, a resonance type speaker which covers a band of a resonance frequency ratio of 2:1 is provided.

Figure 8:
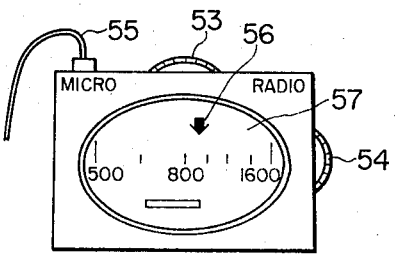
FIG. 8 is a plan view showing the actual packaging of a subminiature radio set.

FIG. 8 is a typical view in the case where the transparent speaker of this invention is applied to a subminiature radio set. The radio set is so constructed that a 1-chip radio receiver of an IC is accommodated in a casing whose size is equal to that of a wrist watch, that a wire for an antenna 55 and a variable capacitor 53 as well as a volume control with a switch 54 are assembled and that a transparent speaker 57 is fitted in the casing. The transparent speaker 57 can serve also as a tuned frequency display window. It does not hamper the display effects of, for example, an arrow 56 indicative of a frequency which is moved by adjusting the variable capacitor, and a bar graph display element which indicates the degree of tuning when the radio receiver has been tuned to the frequency of a broadcast station. These displays and the speaker do not need to be arranged in separate parts, which is advantageous for miniaturization.

As described above in detail, this invention can provide a speaker of small size and good voice characteristics by employing a resonator in a specified shape. This invention is not restricted to the embodiments thereof.

Needless to say, this invention is applied if the corners of a resonator are smoothly molded and formed so as to be roundish. Further, it is easily suggestible by one skilled in the art that especially to the end of enhancing the effect of beauty, the peripheral shape of the resonator is subjected to decorative modifications without greatly demolishing the contour of a predetermined frequency distribution, and it is a matter of course that such changes do not depart from the scope of this invention.

What is claimed is:

1. A transparent flat panel speaker comprising:

(a) a resonator plate having a periphery in the shape of a smooth curve or in the shape of straight lines connected by smooth curves, in either case the curve or curves forming said periphery having at least two centers of curvature;

(b) means for inducing a resonance in said resonator plate comprising:

(i) a plate of transparent piezoelectric material; and (ii) electrodes disposed on opposite faces of said plate of piezoelectric material; and (c) each of said resonator plate, said plate of piezoelectic material and said electrodes being transparent.

2. A transparent flat panel speaker according to claim 1, wherein the shape of said resonator is an ellipse.

3. A transparent flat panel speaker according to claim 2, wherein the ellipse has a major axis which is $\sqrt{1.75}$–$\sqrt{2.25}$ times longer than a minor axis.

4. A transparent flat panel speaker according to claim 1, wherein when normalized, the shape of said resonator is represented by an expression of $X^n+Y^n=1$ (where $4 \leqq n \leqq 20$).

5. A transparent flat panel speaker according to claim 1, wherein when normalized, the shape of said resonator is represented by an expression of $X^n/a+Y^n/b=1$ (where $2 \leqq n \leqq 20$).

6. A transparent flat panel speaker according to claim 1, wherein when normalized, the shape of said resonator is represented by an expression of $X^n/a+Y^nb=1$ (where $4 \leqq n \leqq 20$ and $1 \leqq b/a \leqq \sqrt{2.5}$).

7. A transparent flat panel speaker according to claim 1, wherein the shape of said resonator is a polygon whose corners are smoothly molded.

8. A transparent flat panel speaker according to claim 7, wherein the proportion of the radius of the molding at the corners relative to the length of one side is 3 to 30%.

9. A transparent flat panel speaker according to claim 1, wherein the shape of said resonator consists of a smooth combination of desired parts of a plurality of shapes selected from the group consisting of an ellipse, a shape represented by an expression of $X^n+Y^n=1$ ($4 \leqq n \leqq 20$) when the shape of said resonator is normalized, a shape represented by an expression of $X^n/a+Y^n/b=1$ ($2 \leqq n \leqq 20$) when the shape of said resonator is normalized, and a polygon whose corners are smoothly molded.

10. A transparent flat speaker according to claim 1, wherein said speaker is the speaker of a subminiature radio set fitted to the casing thereof, said transparent speaker covering a display indicative of tuning of said radio set.

11. A transparent flat speaker according to claim 1, wherein said transparent resonator plate comprises the glass cover of a wrist watch, said means for inducing resonance attached to said glass cover with a transparent binder.

12. A transparent flat panel speaker according to claim 1, wherein said resonator is selected from the group consisting of transparent inorganic materials and transparent synthetic resins.

13. A transparent flat panel speaker according to claim 12, wherein said resonator plate is selected from the group consisting of glass, quartz, sapphire and acrylic resin.

* * * * *

UNITED STATES PATENT AND TRADEMARK OFFICE

CERTIFICATE OF CORRECTION

PATENT NO. : 4,352,961

DATED : October 5, 1982

INVENTOR(S) : Akio Kumada, et al

It is certified that error appears in the above—identified patent and that said Letters Patent is hereby corrected as shown below:

Col. 2, line 36, change "harness" to --hardness--.

Col. 3, line 47, correct spelling of "minor".

Col. 3, line 57, change "vibrations" to --vibration--.

Col. 5, line 22, change $\geqq$ to --$>$ --.

In the Claims:

Col. 10, line 31, change "$Y^n b$" to --$Y^n/_b$--.

Signed and Sealed this

Eighteenth Day of January 1983

[SEAL]

Attest:

GERALD J. MOSSINGHOFF

Attesting Officer

Commissioner of Patents and Trademarks